US009945636B2

(12) United States Patent
Thompson

(10) Patent No.: US 9,945,636 B2
(45) Date of Patent: Apr. 17, 2018

(54) BELT HOLSTER ADAPTER PANEL

(71) Applicant: The Fechheimer Brothers Company, Cincinnati, OH (US)

(72) Inventor: Jesse Thompson, North Bend, WA (US)

(73) Assignee: The Fechheimer Brothers Company, Cincinnati, OH (US)

( * ) Notice: Subject to any disclaimer, the term of this patent is extended or adjusted under 35 U.S.C. 154(b) by 46 days.

(21) Appl. No.: 15/095,580

(22) Filed: Apr. 11, 2016

(65) Prior Publication Data

US 2017/0292810 A1 Oct. 12, 2017

(51) Int. Cl.
*F41C 33/00* (2006.01)
*F41C 33/04* (2006.01)

(52) U.S. Cl.
CPC ..... *F41C 33/041* (2013.01); *F41C 33/048* (2013.01)

(58) Field of Classification Search
CPC ..... F41C 33/041; F41C 33/048
USPC ..... 224/674
See application file for complete search history.

(56) References Cited

U.S. PATENT DOCUMENTS 3,430,300 A * 3/1969 Doan ..... A61M 25/02 128/DIG. 26
4,759,963 A * 7/1988 Uso, Jr. ..... A01K 97/08 224/901.4
4,893,381 A * 1/1990 Frankel ..... A44B 18/00 24/16 R
4,939,818 A * 7/1990 Hahn ..... A44B 18/00 24/16 R
5,104,076 A * 4/1992 Goodall, Jr. ..... A45F 5/02 224/251
5,142,743 A * 9/1992 Hahn ..... A44B 18/00 24/16 R
D357,801 S * 5/1995 Short ..... D3/215
5,535,928 A * 7/1996 Herring ..... A45F 5/02 224/250
D377,308 S * 1/1997 McNamara ..... D8/370
5,692,237 A * 12/1997 Bennett ..... A41D 13/0012 2/250
5,829,653 A * 11/1998 Kaiser ..... A45F 4/02 2/2.5
D416,784 S * 11/1999 Singer ..... D13/154
5,991,925 A * 11/1999 Wu ..... A41D 13/0012 2/102

(Continued)

*Primary Examiner* — Peter Helvey
(74) *Attorney, Agent, or Firm* — Wood Herron & Evans LLP

(57) ABSTRACT

The present invention provides an adapter apparatus and method for attaching a holster having at least one belt loop to a surface of another article. The adapter includes a flexible sheet having first and second surfaces. The sheet also has a longitudinally extending central panel with opposite ends. The width of the central panel is sized to pass through a holster belt loop. There is an end panel at each end of the central panel. The end panels have a transverse width greater than the width of the central panel. There are fastener components on the second surface corresponding to a complementary fastener component on a surface of another article. At least one end panel is foldable to a width for passage through the belt loop and then unfolded such that the fastener components will secure the sheet and holster to the surface of the other article.

5 Claims, 4 Drawing Sheets

(56) References Cited

U.S. PATENT DOCUMENTS

| | | | | |
|---|---|---|---|---|
| 6,763,554 | B1 * | 7/2004 | Torrey | B65D 63/10 24/17 AP |
| 6,978,918 | B2 * | 12/2005 | Scanlan | A45C 13/30 224/148.6 |
| D707,830 | S * | 6/2014 | Klutts | D24/190 |
| 2007/0205244 | A1 * | 9/2007 | Hewes, Jr. | A45F 5/02 224/674 |
| 2008/0083803 | A1 * | 4/2008 | Brantner | A45F 5/02 224/666 |
| 2011/0155775 | A1 * | 6/2011 | Craighead | F41C 33/041 224/243 |
| 2015/0192387 | A1 * | 7/2015 | Thompson | F41C 33/0209 224/243 |
| 2016/0091279 | A1 * | 3/2016 | Massaro, Jr. | F41C 33/04 224/581 |

* cited by examiner

BELT HOLSTER ADAPTER PANEL

FIELD OF THE INVENTION

This invention relates to an apparatus that allows an ordinary holster for a firearm or other device to be attached to a surface of another article.

BACKGROUND OF THE INVENTION

A wide variety of holsters for carrying a handgun or other article at one's waistband are readily available and in common use. These include outside-the-waistband ("OWB") holsters or sleeves having one or more passageways through which a belt is threaded to support the holster and article within the holster. Other types of holsters, which provide concealment of the handgun or other article, are known which are positioned inside-the-waistband ("IWB") and include one or more attachment clips to suspend the holster along the waistband and/or belt.

There are other "holsters" and moveable pockets known which secure items inside an article of clothing or accessory article, such as a purse, briefcase, backpack, or book bag. The holsters designed to be worn on the user's waistband or belt, are not readily usable in or attachable to an article or pack.

SUMMARY OF THE INVENTION

The present invention provides an adapter for attaching a holster having at least one belt loop to a surface of another article. It includes a flexible sheet having first and second surfaces. The sheet also has a longitudinally extending central panel with opposite ends. The width of the central panel is sized to pass through a holster belt loop. There is an end panel at each end of the central panel. The end panels have a transverse width greater than the width of the central panel. There are fastener components on the second surface corresponding to a complementary fastener component on a surface of another article. At least one end panel is foldable to a width for passage through the belt loop and then unfolded such that the fastener components will secure the sheet and holster to the surface of the other article.

The fastener components on the second surface may include one component of a hook-and-loop fastener material and the second surface may be substantially covered with the fastener components. The first surface may include complementary components of a hook-and-loop fastener material.

The adapter may also include end panels with portions extending transversely outwardly from the ends of the central panel. The sheet may further include wing panels extending from the end panels longitudinally toward the opposite end of the central panel. The wing panels can have a length such that, when the adapter is assembled with a holster, end portions of opposite wing panels engage with one another.

The invention also includes a method of attaching a holster to a separate article. Other aspects, features, and benefits of the present invention will be apparent from a review of the following detailed description of one embodiment of the invention, the various figures of the drawing, and the claims, all of which comprise disclosure and description of the invention.

BRIEF DESCRIPTION OF THE DRAWING

Like reference numerals are used to indicate like parts throughout the various figures of the drawing, wherein.

DETAILED DESCRIPTION OF THE INVENTION

Figure 1:
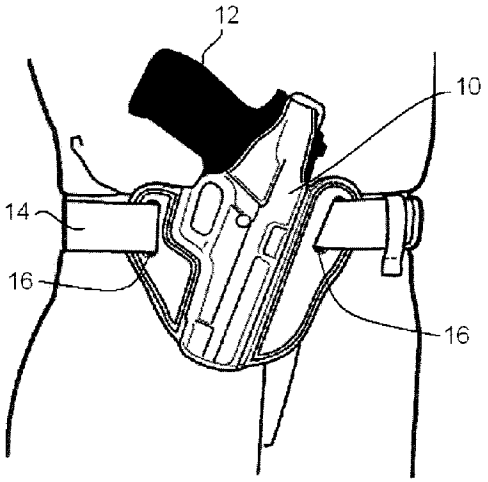
FIG. 1 is an illustration of an ordinary outside-the-waistband holster shown in use on a user's belt.

Referring first to FIG. 1, therein is shown at 10 a holster for a handgun 12 that may be carried on a belt 14 at the user's waistband. As used herein, "holster" may include a holster for a handgun or for some other device, such as an ammunition magazine, a tool, or a mobile phone.

The illustrated holster 10 is of the type commonly known as an outside-the-waistband ("OWB") or "pancake" type holster. Often these are formed from two or more layers of leather or similar material sewn together to form a pocket or sleeve for holding the handgun 12 or other article. In a pancake-type holster, as shown, there are a pair of belt loops 16 in the form of apertures through which a belt 14 may be threaded for suspending the holster 10 on the user's waistband. Other types of OWB holsters include a channel or passageway (not shown) formed between two layers of material through which a belt 14 may be threaded. Other types of holsters intended to carry a handgun 12 or other article at the user's waistband include inside-the-waistband ("IWB") type which are carried inside the user's lower garment (pants or skirt) and have one or more loops or clips through which a belt 14 may be hooked or threaded. As used herein, all of these various structures through which a belt 14 may be threaded are referred to as "belt loops." The adapter of the present invention may be used with any of these types of holsters to secure what is ordinarily a belt holster to the interior or exterior surface of another object, such as a backpack, brief case, purse, or article of clothing.

Figure 2:
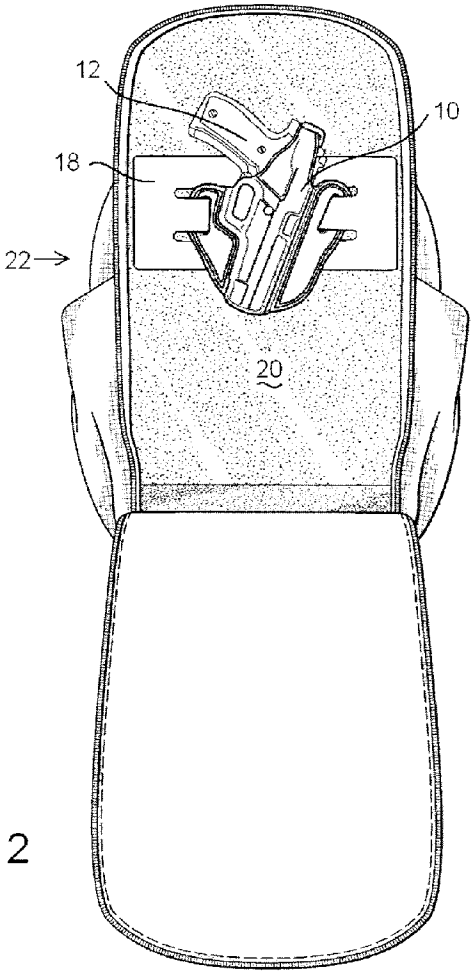
FIG. 2 is an illustration of the holster of FIG. 1 shown attached to an interior surface of a backpack using an adapter panel according to one embodiment of the present invention.

Referring now to FIG. 2, therein is shown an adapter panel 18 of the present invention in use to secure a holster 10 holding a handgun 12 to an interior surface 20 of a backpack 22. Other uses and assembly of the adapter panel 18 will be described below.

The adapter panel 18 may be formed, such as by cutting, from a sheet of flexible material. The adapter panel 18 has an outer surface (shown in FIG. 2) and a reverse surface 24 on the opposite side, which includes a fastener component. According to one embodiment of the present invention, this fastener component may include the hook portion of a hook-and-loop fastener material (as illustrated with shading in FIG. 3). As either component (hook or loop) may be engaged with the complimentary component on another surface, one embodiment of the present invention includes the loop or "pile" component on one surface and the hook component on the reverse surface 24. These materials may be laminated or otherwise fastened to form the two-sided material. One example of this material is available from Velcro USA, Inc. of Manchester, N.H., under the brand ONE-WRAP®.

Figure 3:
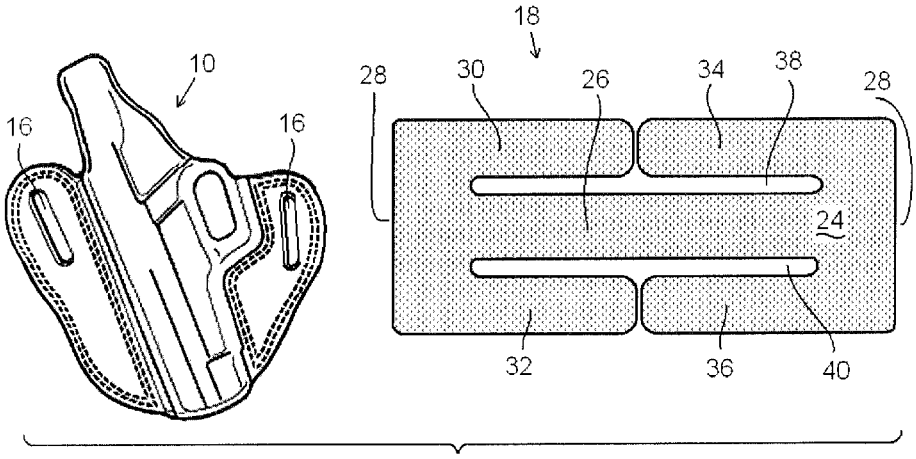
FIG. 3 is an illustration of the reverse side of a belt holster and adapter panel in an unassembled condition.

The adapter panel 18 includes a longitudinally extending central panel 26 with opposite ends. The width of this central panel 26 is sized to pass through the belt loops 16 of a holster 10. Generally, belt loops in a holster are sized to accommodate a belt in the range of 1.25 inches to 2.00 inches in width. At opposite ends of the central panel 26 are end panels 28 which have a width greater than that of the elongated central panel 26. The adapter 18 may also include wing panels 30, 32, 34, 36 which extend longitudinally from the respective end panels 28 toward the opposite end of the central panel 26. As shown in FIG. 3, one wing panel 30 extends toward an opposite wing panel 34 substantially parallel to the longitudinal extension of the central panel 26. Likewise, another wing panel 32 extends toward opposite wing panel 36. Cut-out channels 38, 40 may be provided longitudinally between the central panel 26 and wing panels 30, 32, 34, 36 in order to accommodate the shape of the holster 10 and material forming the holster belt loops 16 without excessive deformation of the adapter panel 18.

Referring now to the series of illustrations shown in FIGS. 3-9, and first to FIG. 3, the reverse or inner side of the holster 10 is shown adjacent the adapter panel 18. The illustrated holster 10 is for a right-hand draw. Of course, the adapter panel 18 may be similarly used with a left-hand draw holster. An example of how an adapter panel 18 is assembled with a typical OWB holster 10 will be described.

Figure 4:
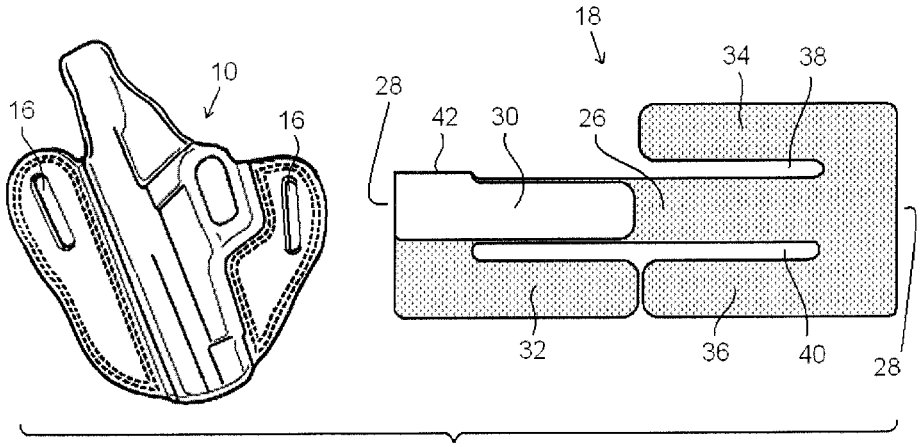
FIG. 4 is a view similar to FIG. 3 in which a first step in the assembly of the adapter panel to the holster is illustrated.
Figure 5:
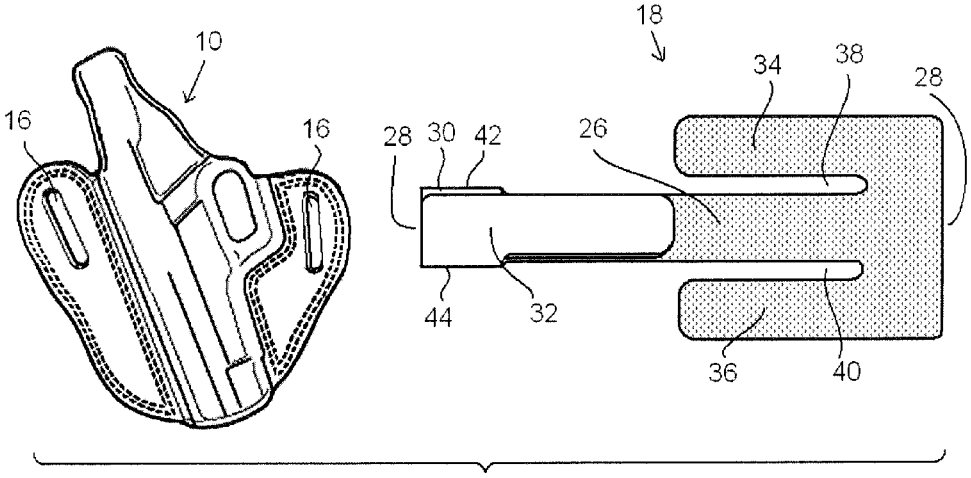
FIGS. 5-8 illustrate subsequent sequential steps in the assembly of a holster and an adapter panel according to one embodiment of the present invention.

Referring to FIGS. 4 and 5, one end portion 28, which may include wing panels 30, 32, is folded to present an overall width similar to that of the central panel 26 and of a size to pass through the belt loop 16 of the holster 10. As illustrated, the first wing portion 30 may be folded over along a line 42 substantially parallel to the longitudinal direction of the central panel 26 (FIG. 4). Then, the opposite side of the end panel 28, which may include wing panel 32 is similarly folded along an opposite fold line 44 substantially parallel to the longitudinal extension of the central panel 26. When double-sided hook-and-loop fastener material is used for the panel 18, the opposite and complimentary fastener surfaces will engage (loop side of wing 30 faces hook side of wing 32), holding the panel 18 in the folded position illustrated in FIG. 5.

Figure 6:
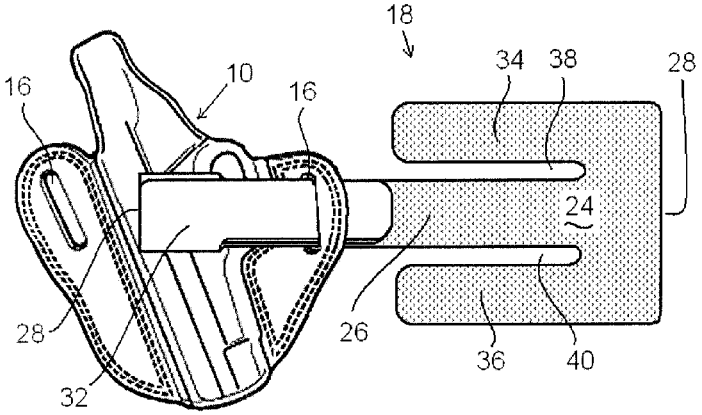
Figure 7:
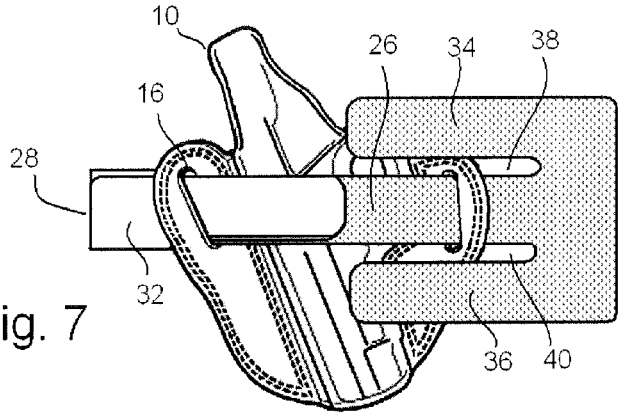
Figure 8:
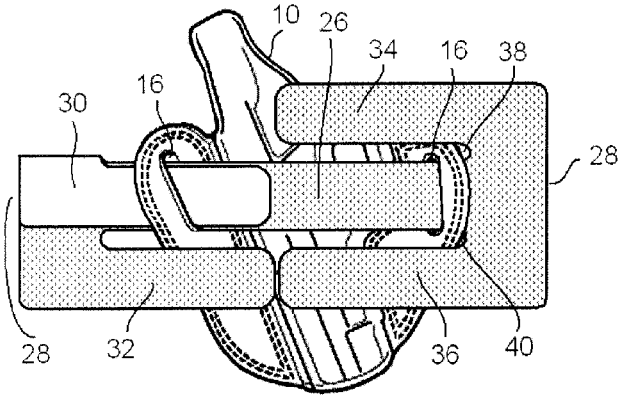

As shown in FIGS. 6 and 7, this folded end of the adapter panel 18 and the longitudinal central panel 26 is threaded first through one belt loop 16 and then the other 16 of the holster 10 so that the central panel 26 passes along the reverse or inner surface of the holster 10, much like a belt. The unfolded wing panels 34, 36 likewise extend over the inner or reverse side of the holster 10 (FIGS. 8 and 9), as accommodated by the cut-out channels 38, 40.

Figure 9:
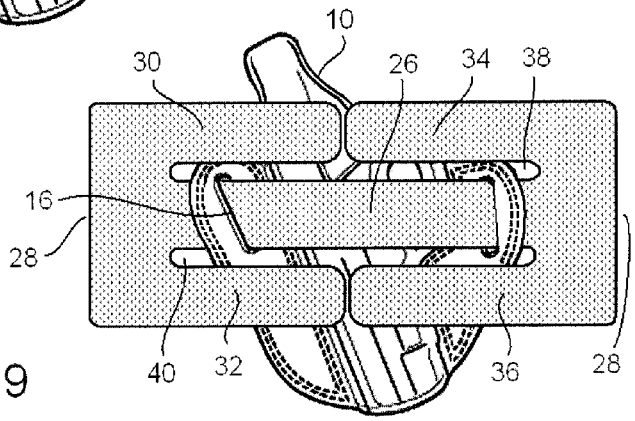
FIG. 9 illustrates the reverse side of a holster and adapter panel in a fully assembled condition.

Once the folded section is fully extended through the belt loops 16, the wing panels 30, 32 of the end panel 28 are unfolded, first one and then the other (FIG. 8), and the wing panels 30, 32 are extended to reach toward the opposite wing panels 34, 36 (FIG. 9). In some situations, the thickness or shape of the holster 10 or material forming the belt loop 16 will deform the central panel 26 from a strictly planar shape. This deformation may allow the free ends of opposing wing panels 30/34, 32/36 to overlap slightly. This is not detrimental and does not detract in any way from the function of the adapter panel 18. If two-sided material with complimentary components of hook-and-loop fastener material are used on opposite sides of the adapter panel 18, the free ends of the opposing wing panels 30/34, 32/36 may engage and fasten together. As seen in FIG. 9, when substantially all of the reverse surface 24 of the adapter panel 18 is covered with one component (e.g., hook component) of hook-and-loop fastener material, a large area for engagement is presented. The assembled unit shown in FIG. 9 may be inverted so that the reverse surface 24 can be placed against the interior surface 20 of another article, such as a backpack 22. So long as it has sufficient fleece or pile, the interior surface 20 will engage with the hook component of hook-and-loop fastener material.

Alternatively, other types of fasteners, such as snaps or the like, may be provided on the reverse surface 24 of the adapter panel 18 and interior surface 20 of the article to which the holster 10 is to be attached. The use of hook-and-loop fastener material, however, allows the holster 10 to be repositionably attached to another article with a wide variety of placement adjustability.

While exemplary embodiments of the present invention have been illustrated and described in detail, it should be apparent that other modifications and variations thereto are possible, all of which fall within the true spirit and scope of the invention. Therefore, the foregoing is intended only to be illustrative of the principles of the invention. Further, since numerous modifications and changes will readily occur to those skilled in the art, it is not intended to limit the invention to the exact construction and operation shown and described. Accordingly, all suitable modifications and equivalents may be included and considered to fall within the scope of the invention, which is defined by the following claim or claims.

What is claimed is:

1. An adapter for attaching a holster having at least one belt loop to a surface of another article, comprising:

a flexible sheet having first and second surfaces, the sheet having:

a longitudinally extending central panel with opposite ends and a width sized to pass through a belt loop of a holster;

an end panel at each end of the central panel, the end panels having a transverse width greater than the width of the central panel; and fastener components on the second surface corresponding to a complementary fastener component on a surface of another article, wherein at least one end panel is foldable to a width for passage through the belt loop and then unfolded such that the fastener components will secure the sheet and holster to the surface of the other article, wherein the end panels include portions extending transversely outwardly from the ends of the central panel, and wherein the sheet further comprises wing panels extending from the end panels longitudinally toward the opposite end of the central panel.

2. The adapter of claim 1, wherein the wing panels have a length such that, when the adapter is assembled with a holster, end portions of opposite wing panels engage with one another.

3. A holster adaptably securable to another article, comprising:

a holster having at least one belt loop;

an adapter panel formed from a flexible sheet having first and second surfaces, the flexible sheet having:

a longitudinally extending central panel with opposite ends and a width sized to pass through a belt loop of a holster;

an end panel at each end of the central panel, the end panels having a transverse width greater than the width of the central panel and include portions extending transversely outwardly from the ends of the central panel, further including wing panels extending from the end panels longitudinally toward the opposite end of the central panel; and first fastener components on the second surface complementary to another fastener component; and another article separate from the holster and adapter panel having a surface with second fastener components complementary to the first fastener components on the second surface of the sheet, wherein at least one end panel is foldable to a width for passage through the belt loop and then unfolded such that the fastener components will secure the sheet and holster to the surface of the other article.

4. The combination of claim 3, wherein the wing panels have a length such that, when the adapter is assembled with a holster, end portions of opposite wing panels engage with one another.

5. The combination of claim 4, wherein the holster has two belt loops.

* * * * *